US007823363B2

(12) United States Patent
Boesch et al.

(10) Patent No.: US 7,823,363 B2
(45) Date of Patent: Nov. 2, 2010

(54) POURED WALL UNIT

(76) Inventors: Charles R. Boesch, 2671 Grassy Branch Dr., Medina, OH (US) 44256; Jeffrey W. Boesch, 3355 Valley Pkwy., North Royalton, OH (US) 44133; Stephen J. Boesch, 2685 Grassy Branch Dr., Medina, OH (US) 44256

( * ) Notice: Subject to any disclaimer, the term of this patent is extended or adjusted under 35 U.S.C. 154(b) by 0 days.

(21) Appl. No.: 12/423,098

(22) Filed: Apr. 14, 2009

(65) Prior Publication Data

US 2009/0255209 A1 Oct. 15, 2009

Related U.S. Application Data

(60) Provisional application No. 61/044,610, filed on Apr. 14, 2008.

(51) Int. Cl.
*E04B 1/00* (2006.01)

(52) U.S. Cl. ..... 52/742.14; 52/215; 52/216; 52/205; 249/39

(58) Field of Classification Search ..... 52/742.14, 52/216, 215, 745.15, 205; 249/39
See application file for complete search history.

(56) References Cited

U.S. PATENT DOCUMENTS 3,502,296 A * 3/1970 Comment ..... 249/27
4,430,831 A 2/1984 Kemp
5,496,231 A 3/1996 Eaton
5,882,540 A * 3/1999 Farrington ..... 249/34
5,927,043 A * 7/1999 Newkirk ..... 52/742.14
6,185,884 B1 * 2/2001 Myers et al. ..... 52/215
6,401,413 B1 * 6/2002 Niemann ..... 52/309.12
6,412,231 B1 * 7/2002 Palatin ..... 52/79.1
6,904,727 B2 * 6/2005 Edger ..... 52/215
7,490,442 B1 * 2/2009 Jackson et al. ..... 52/215
7,587,868 B2 * 9/2009 Hughes ..... 52/215
2003/0177737 A1 * 9/2003 Byrd ..... 52/742.14
2008/0115431 A1 * 5/2008 Mill ..... 52/215
2008/0216420 A1 * 9/2008 Brewka et al. ..... 52/107
2009/0235601 A1 * 9/2009 Mellett ..... 52/426

* cited by examiner

*Primary Examiner*—Richard E Chilcot, Jr.
*Assistant Examiner*—Mark R Wendell
(74) *Attorney, Agent, or Firm*—Pearne & Gordon LLP

(57) ABSTRACT

A method for installing a window in or within a poured concrete wall is disclosed. The method comprises a kit with at least one window block. It also includes a first spacer adapted to abut a first side of the glass block and a second spacer adapted to abut a second side of the window block. The method implementing the kit includes the steps of erecting a wall form comprising of a first and a second form, locating the kit in between the first and second form, placing concrete into the wall form around the window kit, removing the first and second wall forms, and removing the first and second spacers.

15 Claims, 4 Drawing Sheets

| | | 7 ¼" | 7 5/8" | 8" |
|---|---|---|---|---|
| 32x8 | Outside Piece | 31 ¼ x 8 7/16 x 2" | 31 ¼ x 8 7/16 x 2" | 31 ¼ x 8 7/16 x 2 ½" |
| | Inside Piece | 31 ¼ x 8 7/16 x 2" | 31 ¼ x 8 7/16 x 2 ½" | 31 ¼ x 8 7/16 x 2 ½" |
| 32x16 | Outside Piece | 31 ¼ x 16 ¼ x 2" | 31 ¼ x 16 ¼ x 2" | 31 ¼ x 16 ¼ x 2 ½" |
| | Inside Piece | 31 ¼ x 15 5/8 x 2" | 31 ¼ x 15 5/8 x 2 ½" | 31 ¼ x 15 5/8 x 2 ½" |
| 32x24 | Outside Piece | 31 ¼ x 23 7/8 x 2" | 31 ¼ x 23 7/8 x 2" | 31 ¼ x 23 7/8 x 2 ½" |
| | Inside Piece | 31 ¼ x 23 7/8 x 2" | 31 ¼ x 23 7/8 x 2 ½" | 31 ¼ x 23 7/8 x 2 ½" |

POURED WALL UNIT

CROSS-REFERENCE TO RELATED APPLICATIONS

This application claims the benefit of U.S. Provisional Application Ser. No. 61/044,610, filed Apr. 14, 2008 and incorporated herein by reference.

FIELD OF THE INVENTION

The present invention relates to an apparatus for and method of installing a window or panel within a poured concrete wall.

DESCRIPTION OF RELATED ART

Concrete walls offer resistance to rot, rodents, termites and fungus, and are not toxic. Solid concrete walls possess greater flexural and compressive strength than concrete blocks and can better resist lateral pressure. They are also more fire resistant and more impervious to water. These advantages make a poured concrete wall an excellent choice as a foundational wall.

Glass block windows or panels provide functional as well as aesthetic purpose. They offer medium privacy, allow light transmission, form a sound barrier, and enhance the beauty of the decor. Furthermore, glass blocks are durable and easy to clean.

Glass block is typically installed in a poured concrete wall after the wall is poured. It would be desirable to pour the wall with the glass block window in place, rather than installing the block after the wall is poured.

BRIEF SUMMARY OF INVENTION

A method for installing a window in or within a poured concrete wall is disclosed. The method comprises a kit with at least one window block. It also includes a first spacer adapted to abut a first side of the glass block and a second spacer adapted to abut a second side of the window block. The method implementing the kit includes the steps of erecting a wall form comprising of a first and a second form, locating the kit in between the first and second form, placing concrete into the wall form around the window kit, removing the first and second wall forms, and removing the first and second spacers.

DETAILED DESCRIPTION OF THE INVENTION

Figure 1:
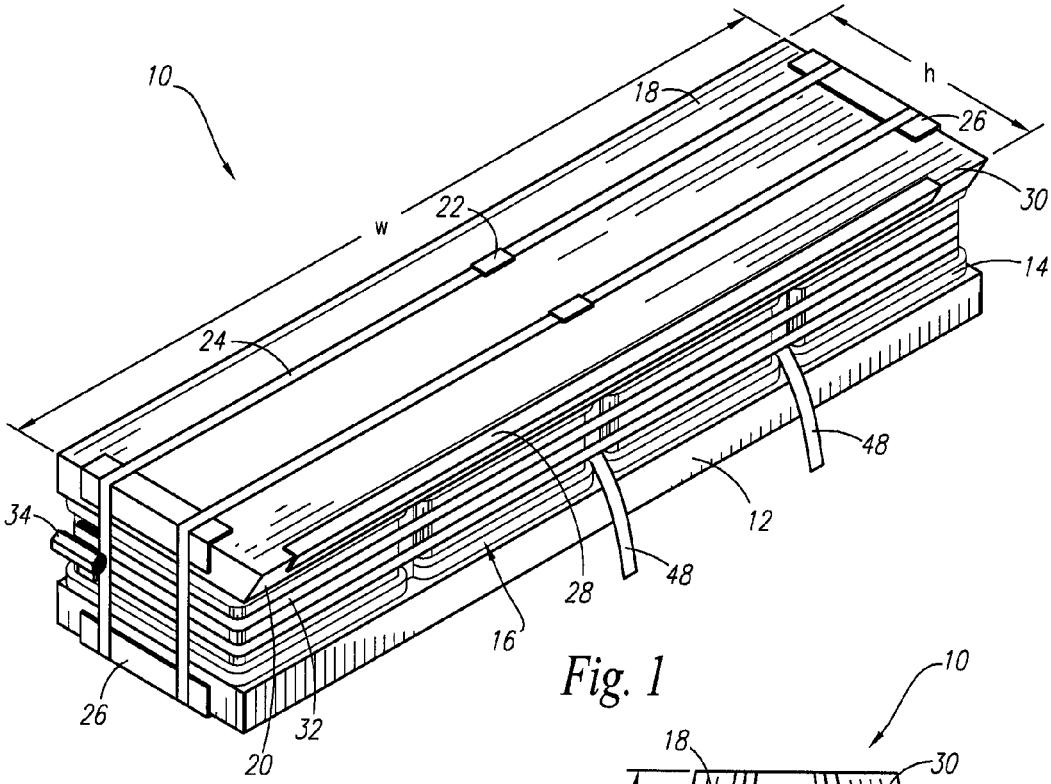
FIG. 1 is an illustration of a perspective view of an assembled window kit.

The present invention will now be described with reference to the figures, wherein like reference numerals are used to refer to like elements throughout. It is to be appreciated that the various illustrations are not necessarily absolute, and in particular that the size of the components are suitable for the example and for facilitating the understanding of the method. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

Disclosed is a system and method for installing a device in a poured concrete wall. Example devices which can be installed in a poured wall using the disclosed system and method include windows, (e.g., glass block, hopper, etc.), doors, vents and pipe sleeves. Conventional method of installing such devices in a poured concrete wall include making a form, placing the concrete into the form and around the device preform, then installing the desired device into the opening left from the device preform. In the current disclosure, the method hangs the device between the forms for the poured wall prior to pouring concrete. The device is held in place by the cured concrete wall and does not have to be separately installed after the wall is formed. This eliminates any need for custom preparation in the making of a form and also eliminates any need for custom fitting of the device during installation and after the concrete wall has been constructed.

The system and method will be described below with respect to the installation of a glass block window in a poured concrete wall. It is to be appreciated that the system and method are applicable to the installation of other devices in poured concrete walls, such as doors, vents and pipe sleeves. As used herein, the term "poured" refers to any method well known to one of ordinary skill in the art including pouring the concrete, pumping the concrete into the desired position and placing the concrete via a gravity fed method.

Figure 3:
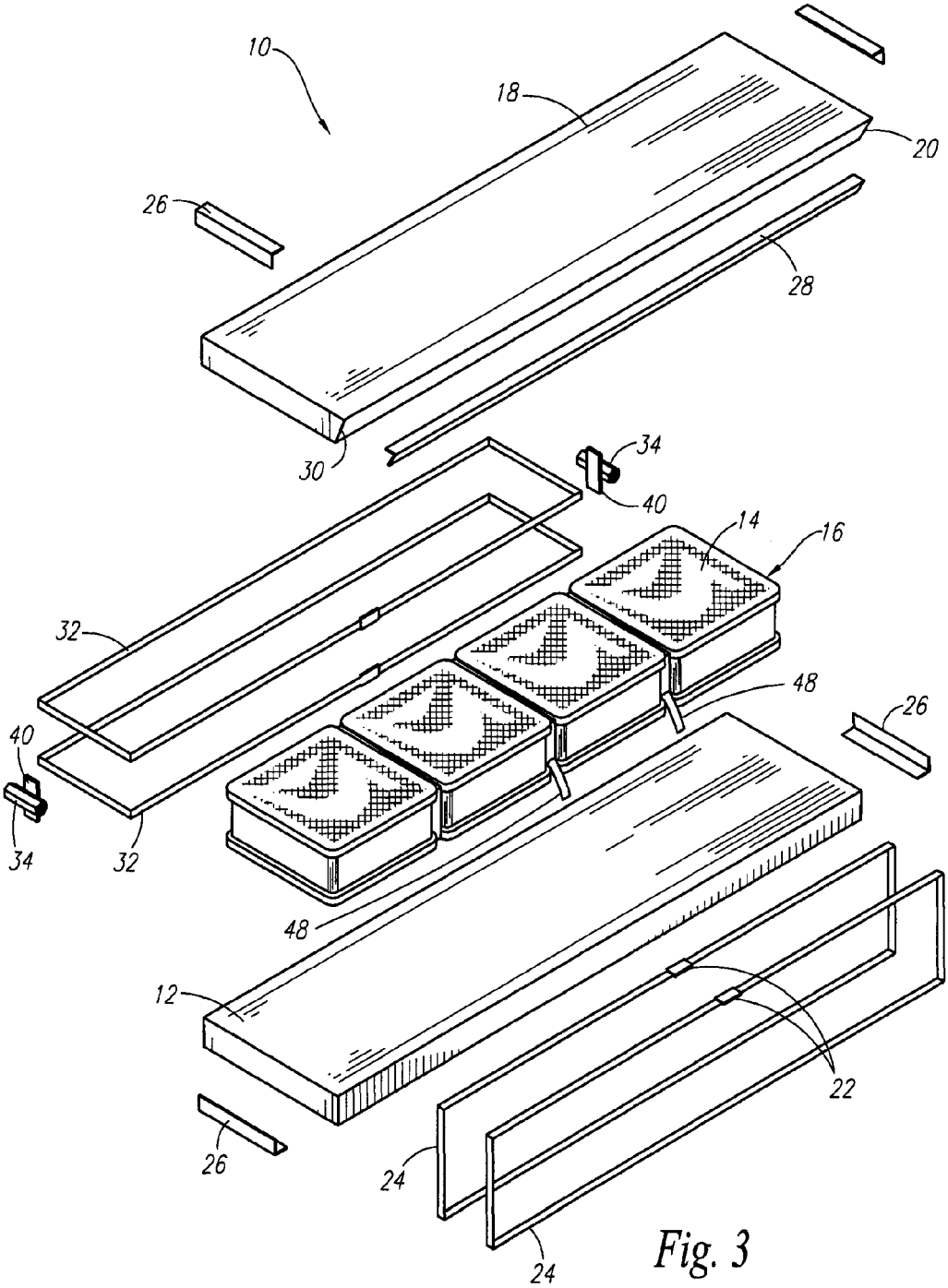
FIG. 3 is an exploded view of the kit showing all the components.
Figures 6, 7:
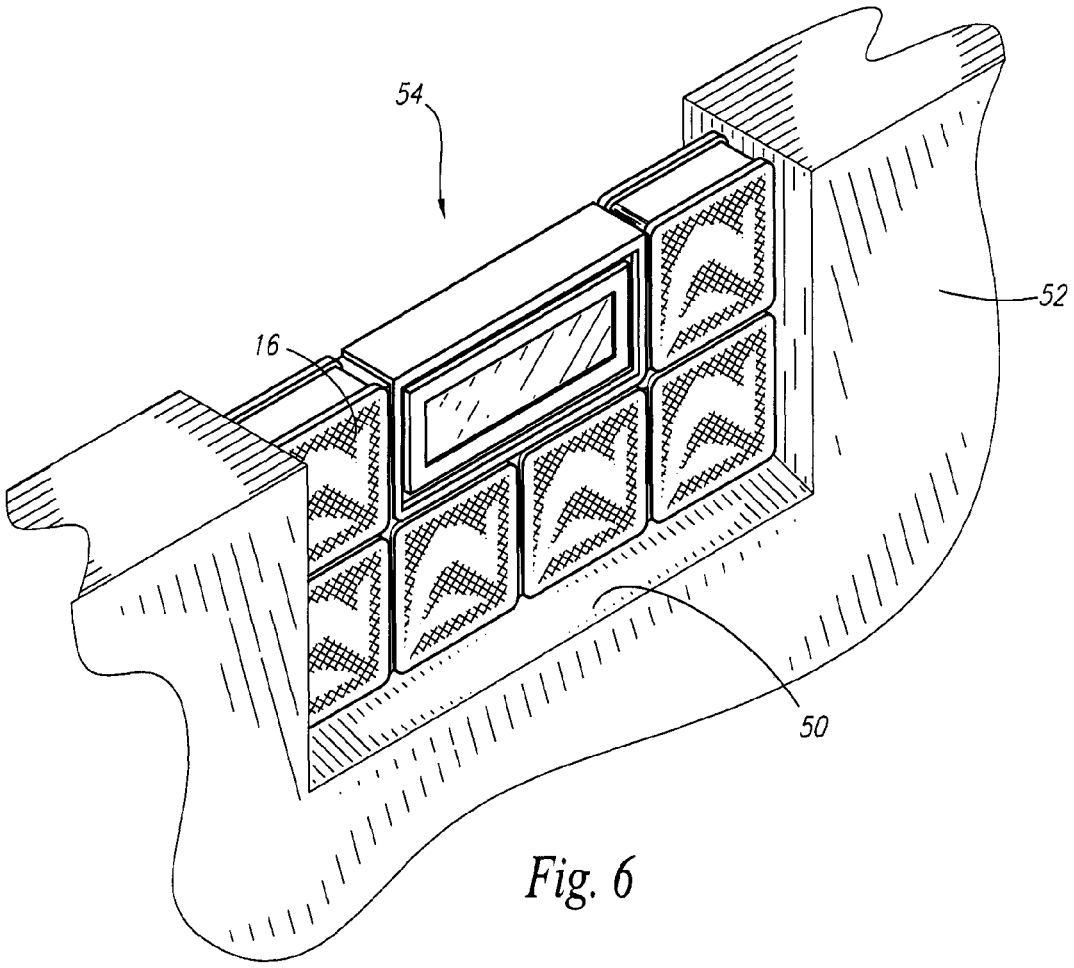
FIG. 6 is a perspective view of the cured wall with the window in place.
FIG. 7 is a table listing the dimensions of the inside and outside spacers according to the thickness of the desired window.

With reference to FIG. 3, the components of an assembly or kit 10 are shown in an exploded view. A pre-assembled panel 16, such as a glass block panel, can include several individual glass blocks 14 that are held together via an adhesive, such as a silicone adhesive. The panel 16 can vary in size, shape, number of blocks, or it can be a composite of two or more window types. For example, as shown in FIG. 6, the window can include more than one row of glass blocks 14, and also can contain a fully transparent window that can be adapted to open to allow for air circulation. Additionally, the kit can only contain a window panel 16 and can not include glass blocks 14.

Figure 2:
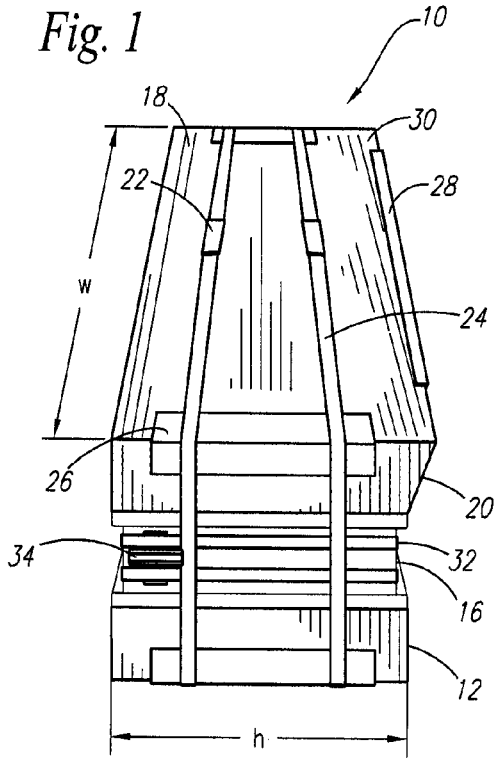
FIG. 2 is an angled side view of the assembled kit.

With further reference to FIGS. 1-3, and in one embodiment, the panel 16 can be dispersed between a first and second spacer 12, 18 respectively. In another embodiment, the first or second spacer 12, 18 can be, for example, a 2½ inch thick rectangular prism whose length and width substantially correspond to the length and width of the pre-assembled panel 16. The second spacer 18 can be installed on the opposing side of the panel 16 with generally the same dimensions as first spacer 12. Additionally, in one embodiment, the second spacer 18 can have an angled edge 20, to be discussed later.

Furthermore, the spacers 12, 18 can have dimensions that are substantially equivalent to the width w and height h dimensions of the panel 16. Moreover, the thickness of the spacers 12, 18 and overall thickness of the kit 10 can tend to be equivalent to the desired thickness of the wall to be constructed. The spacers 12, 18 in one embodiment can be formed out of extruded 2 lb. polystyrene foam, but should not be solely limited to these examples.

As an additional example, a 7⅝ inch thick wall can require that the overall thickness of the kit 10 be equivalent to 7⅝ inches. In one embodiment, the first spacer 12 can have a thickness of 2½ inches and second spacer 18 can have a thickness of 2 inches and panel 16 can have a thickness of about 3⅛ inches. Thus, removal of the spacers 12, 18 can result in a recess on both sides of the panel 16. Accordingly, in a 7⅝ inch thick wall the inner recess can be 2½ inches and the outer recess can be 2 inches. However, the spacers 12, 18 can be customized to fit any desired width w, height h, and thickness to meet the specifications and requirements of an application.

With reference to FIG. 7, the example dimensions are listed showing various sizes of spacers 12, 18 and panels 16. It should be noted that actual dimensions can vary slightly, as the nominal and actual dimensions are listed. The nominal dimensions are noted to simplify calculations for brick masons and other tradesmen. For example, if a wall to be constructed has an overall nominal thickness of 7¼ inches (7⅛ inches actual) and a nominal dimensioned 32×16 inch panel 16 (31×15½ inches actual dimension) is to be a installed within the wall, the first spacer 12 (inside piece) can have dimensions of 31¼"×15⅝"×2" and the second spacer 18 (outside piece) can have dimensions of 31¼"×16¼×2". It should also be noted that the difference in height between the first and second spacer is due to the angled edge 20. Therefore, as the actual height of the panel 16 is 15½ inches and actual width is 31 inches, and as the spacers 12, 18 both have a relative height of 15⅝ inches and width of 31¼ inches, a space of about ⅛ inch remains around the sides and bottom while the top of the panel 16 is flush with the opening. As a result of the ⅛ inch, if a glass block 14 were to become damaged and require a replacement, the dimension differences between the spacers 12, 18 and panel 16 can aid in removal of one or more glass blocks 14 from a finished wall.

As discussed above and shown in FIGS. 1 and 2, the second spacer 18 can have an angled edge 20. The panel 16 and related angled edge 20 are meant to be the exterior portion of the finished window 54. After the wall has cured, the angled edge 20, forms a wash 50, shown in FIG. 6, in the finished wall 52 below the panel 16 so moisture flows away from the exterior recess. Accordingly, the side of the second spacer 18 facing away from the panel 16 can have a larger surface area than the side of the second spacer 18 abutting the panel 16.

As shown in FIGS. 1-3, a flex band 24 can be installed around the panel 16 and the first and second spacers 12,18 along the width, w, of the first and second spacers. The flex band 24 can provide enough force to hold the first and second spacers 12, 18 in place around the panel 16. More than one flex band 24 can be used to hold the kit together, depending on the strength of the flex band and the weight of the kit 10. In another embodiment, if the flex band 24 is a single length having two opposing ends, a fastener 22 can be used to connect the two ends of the flex band 24 together around the kit 10. In yet another embodiment, the flex band 24 can be a continuous loop, thus a fastener 22 would not be required. Therefore, if a plurality of kits were being constructed having a standard number of glass blocks, a continuous loop flex band can be used to eliminate the fastener 22. However, if constructed kits were variable as to width, w, height, h and thickness, one flex band 24 would not appropriately hold the kit together, fasteners 22 can be used.

In yet another embodiment, the spacers 12, 18 can be secured directly to the panel 16. This can be done by placing a small amount of glue or epoxy onto each glass block 14, contacting the spacers 12, 18 to the panel 16 and applying pressure to the spacers 12, 18 to form a secure connection. It should be noted that flex bands 24 are optional in this embodiment. After both spacers 12, 18 have been secured to the panel 16, a bead of epoxy can be laid around the edge between the panel and each spacer. The dried glue acts as barrier and prevents the viscous concrete from flowing between the panel 16 and each spacer 12, 18 at the time of construction. In a related embodiment, the spacers 12, 18 can be substantially wrapped in packing tape. The packing tape is designed to protect the foam spacers 12, 18 and also aids in separating the spacers 12, 18 from the panel 16 after construction of the wall is complete.

Additionally, a handle feature can be added to assist in transporting the kit 10. By using two fasteners 22 at opposing ends of the shorter flex band and secured to the flex band 24, the shorter flex band creates a handle to provide a single-handed carrying method for the kit 10. In another embodiment, more than one short flex band can be attached to more than one flex band 24, for increased load capability. For example, a first short flex band can be attached to a first flex band 24, and a second short flex band can be attached to a second flex band 32. The first and second short flex bands can then be fastened together to create one handle, thus adding additional stability and increased durability.

In yet another embodiment, a large number of glass blocks in a single panel 16 can require that the fasteners 22 can be made of a metal or metal alloy. The fastener 22 can be required to hold the two ends of the flex band 24 together while being subjected to the large amount of force produced by the weight of the panel 16. However, less demanding applications can permit the use of a plastic fastener 22. In yet another embodiment, fasteners 22 can be integrated into the two ends of the length of flex band 24. The fasteners can posses other means of fastening the two ends of the flex band 24 together, such as hook and loop fasteners or an interlocking means.

With further reference to FIGS. 1-3, 90° side protectors 26 can be positioned at the four edges of the kit 10 with respect to the width w where the flex band 24 would contact the spacers 12, 18. Depending on the strength of the flex bands 24, a large amount of force can be subjected onto the corner of each spacer 12, 18 and can create a groove in the corners of the spacers 12, 18 which would possibly result in unwanted movement between the glass block panel and spacers 12, 18. Thus, the side protectors 26 would protect the corners of the spacers 12, 18 from the concentration of force that the flex bands 24 can apply and prevent any component shifting. Additionally, side protectors 26 can protect the spacers 12, 18 during shipment to the construction site and during the placement and pouring process. In another embodiment, a 30° protector 28 is positioned on the lip 30 of second spacer 18 which protects the lip 30 of the second spacer during shipment to the site and during the placement and pouring process. The edge of the 30° protector 28 that contacts the second spacer 18 can be coated with an adhesive, so that the 30° protector 28 stays in contact and protects the second spacer until the second spacer is separated from the panel 16. In an alternative embodiment where the spacers 12, 18 are glued to the panel 16, side protectors 26 can not be required.

Figure 4:
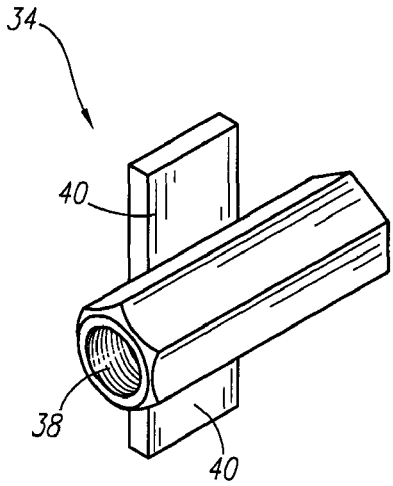
FIG. 4 is a perspective view of the metal hanger.

As shown in FIG. 1, an internally threaded metal hanger 34 can be located at each of the upper corners of the panel 16. As shown in FIG. 4, the metal hanger 34 can have flanges 40 that can permit a second flex band 32 to pass over the flange 40 and secure the metal hanger 34 to the panel 16 in a direction that can be parallel to the height, h. The flanges 40 can be welded to the hanger 34. The metal hanger 34 can be, for example, a hex-coupling nut or rod coupler, with internal female threading 38 that is adapted to accept a male threaded connection. For this application, an acceptable hex-coupling nut size can be about a ¼ inch. Also, since the metal hanger 34 has a pair of flanges 40, an additional second flex band 32 can be used to provide additional strength with which to hold the metal hanger 34 to the panel 16. In an alternative embodiment, the hex coupling nuts are secured directly to the panel 16 using an adhesive, such as an epoxy or a waterproof two-sided tape. In this embodiment, the flange 40 can be eliminated. Accordingly, the metal hanger 34 sans flanges 40 can be glued directly to each side of the panel 16.

Figure 5A:
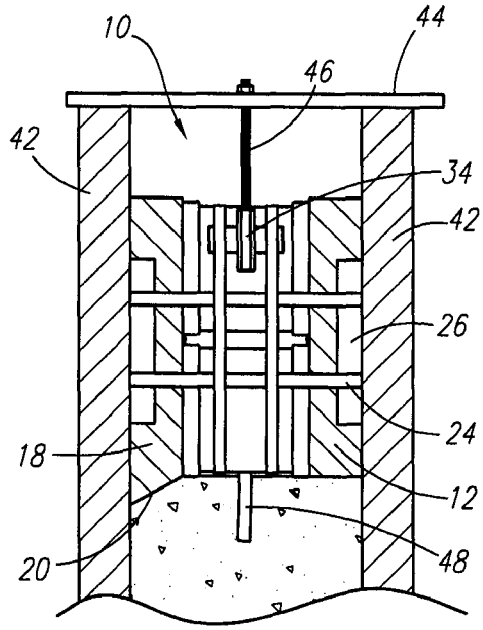
FIG. 5A is a cross-sectional side view of the assembled kit installed in a wall form.

In yet another embodiment, and as shown in FIGS. 1 and 5A, wall anchors 48 are secured, for example glued, in between the individual glass blocks 14 of panel 16 during assembly of the panel. The wall anchors 48 extend perpendicularly from the panel 16 into the concrete wall, providing additional window reinforcement and stability. Additionally, the number of wall anchors 48 can be tailored to the specifications of the builder, so that the panel 16 is adequately secured to the poured wall.

A method of using the window kit is hereby described.

After a panel 16 is constructed from one or more glass blocks 14 and wall anchors 48 secured into place, metal hangers 34 are secured to the upper corners of the panel 16. If the second flex band 32 has a length and is not a continuous band, the flex band is fastened together via a fastener 22. After the metal hanger 34 has been fastened to the panel 16, the spacers 12, 18 are attached to each side of the panel 16. Side protectors 26 are placed on the edges of each spacer 12,18, and the flex band 24 is then wrapped around the two spacers and contacting the protectors 28, which secures the two spacers to the panel 16. At this point or any point prior, the 30° protector 28 can be connected to the angled edge 20 on the second spacer 18. After assembly of the kit 10 is completed, the entire window assembly is shipped to a construction site in its assembled form.

Figure 5B:
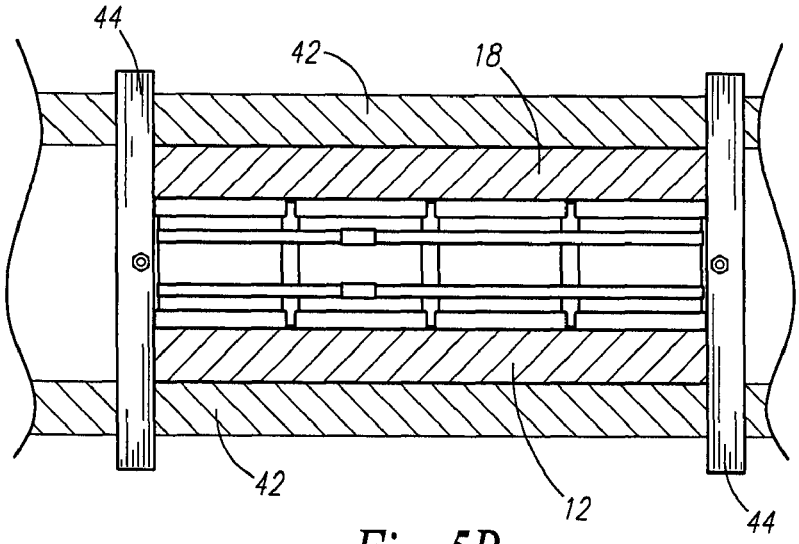
FIG. 5B is a top view of the assembled kit installed in a wall form.

With reference to FIGS. 5A and 5B, in preparation for pouring concrete to form a freestanding wall, opposing wall forms 42 can be erected. The opposing wall form 42 is made up of two freestanding elements that act as the barrier for the poured concrete. Thus, when the concrete is poured into the wall form 42, the free standing elements will hold the concrete in place, allowing it to cure. Once the concrete has cured, the wall form 42 is removed, revealing the concrete wall. This process is well known to a person of skill in the art and therefore will not be discussed further.

Once the wall forms 42 are erected, a male threaded bolt 46 is inserted through a hole in a mount 44 or cross-bar and secured together. This process is repeated for a second male threaded bolt 46 and a second mount 44. Then the male threaded bolt 46 is secured into the metal hanger 34 at each corner of the kit 10. Once the bolt and mount assembly is securely fastened to the kit 10 via the metal hanger 34, the window kit 10 is then lowered in between the wall forms 42 until the mount 44 rests on the top edges of the wall forms 42, thus hanging the window kit 10 at the desired height and position, as shown in FIG. 5A. In another embodiment, the metal hanger 34 can be adapted to be secured to internal concrete wall reinforcements, such as reinforcing bars, or "rebar".

Additionally, as shown in FIG. 5B, the spacers 12, 18 can be in flush contact with the wall form 42. The window kit 10 should fit tightly into the wall form so that it prevents any concrete from flowing between each spacer 12, 18 and corresponding wall form.

After the window kit 10 is securely in place, concrete can be poured into the wall form 42 and around the window kit 10. If the desired location of the window makes the window kit 10 accessible after the pouring of and drying of the concrete, any remains of the kit, such as flex bands, can be removed. Once the concrete has cured and wall forms removed, the spacers 12, 18 can be removed. What is left is panel 16 window securely fastened to the concrete wall, with a wash 50 on the exterior portion of the wall 52 of the finished window 54, as shown in FIG. 6.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A method of installing a window in a poured concrete wall, comprising the steps of:

providing a window panel, the window panel comprising a light-transmissive member;

erecting opposing first and second wall forms;

placing the window panel between the opposing first and second wall forms at a desired height;

placing concrete between the opposing first and second wall forms so as to substantially surround the window panel with the concrete, wherein the light-transmissive member is in direct contact with the concrete.

2. The method of claim 1, wherein the light-transmissive member comprises a plurality of light-transmissive blocks in direct contact with the concrete.

3. The method of claim 2, wherein the window panel is openable, thereby allowing air circulation through the window panel when opened.

4. The method of claim 1, wherein, during the step of placing concrete between the opposing first and second wall forms, a first foam spacer is disposed between the window panel and the first wall form, and a second foam spacer is disposed between the window panel and the second wall form, and wherein the second foam spacer comprises a downwardly-angled edge that forms a wash in the concrete adjacent the light-transmissive member.

5. The method of claim 4, further comprising the steps of:

choosing the first foam spacer based on a thickness of a wall formed by the concrete and a thickness of the first foam spacer; and choosing the second foam spacer based on the thickness of the wall formed by the concrete and a thickness of the second foam spacer, wherein the window panel is alternatively installable in walls of different thicknesses based on the steps of choosing.

6. The method of claim 4, further comprising the steps of:

gluing the first foam spacer to the light-transmissive member; and gluing the second foam spacer to the light-transmissive member.

7. The method of claim 4, wherein a total thickness comprising a thickness of the first foam spacer, a thickness of the second foam spacer and a thickness of the window panel equals a thickness of a wall formed by the concrete, and wherein a width of the first foam spacer and a width of the second foam spacer are greater than a width of the, window panel.

8. The method of claim 7, wherein the light-transmissive member comprises a plurality of light-transmissive blocks in direct contact with the concrete.

9. The method of claim 8, wherein the window panel is openable, thereby allowing air circulation through the window panel when opened.

10. A method of installing a window in a poured concrete wall, comprising the steps of:

providing an assembly comprising a window panel, a first foam spacer and a second foam spacer, wherein the window panel comprises a light transmissive member located between the first foam spacer and the second foam spacer;

erecting opposing wall forms;

placing the assembly between the opposing wall forms at a desired height; and placing concrete between the opposing wall forms so as to substantially surround the assembly with the concrete, wherein the light-transmissive member is in direct contact with the concrete, and wherein the second foam spacer comprises a downwardly-angled edge that forms a wash in the concrete adjacent the light-transmissive member.

11. The method of claim 10, wherein a total thickness comprising a thickness of the first foam spacer, a thickness of the second foam spacer and a thickness of the window panel equals a thickness of a wall formed by the concrete, and wherein a width of the first foam spacer and a width of the second foam spacer are greater than a width of the window panel.

12. The method of claim 10, further comprising the steps of:

choosing the first foam spacer based on a thickness of a wall formed by the concrete and a thickness of the first foam spacer; and choosing the second foam spacer based on the thickness of the wall formed by the concrete and a thickness of the second foam spacer, wherein the window panel is alternatively installable in walls of different thicknesses based on the steps of choosing.

13. The method of claim 10, wherein the first foam spacer and the second foam spacer are glued to the light transmissive member.

14. The method of claim 10, wherein the light-transmissive member comprises a plurality of light-transmissive blocks in direct contact with the concrete.

15. The method of claim 14, wherein the window panel is openable, thereby allowing air circulation through the window panel when opened.

* * * * *